United States Patent [19]

Montgomery et al.

[11] Patent Number: 4,972,781

[45] Date of Patent: Nov. 27, 1990

[54] FOLDABLE TRAY TABLE

[76] Inventors: Jean K. Montgomery; Daniel G. Murdoch, both of 3 Sniffen Ct., Westport, Conn. 06880

[21] Appl. No.: 439,246

[22] Filed: Nov. 20, 1989

[51] Int. Cl.[5] ..... A47B 85/00

[52] U.S. Cl. ..... 108/25; 108/19

[58] Field of Search ..... 108/25, 19, 26, 45, 108/44, 130, 132, 128; 248/439; 211/132

[56] References Cited

U.S. PATENT DOCUMENTS

| | | | |
|---|---|---|---|
| 2,636,794 | 4/1953 | Sternkopf | 108/19 |
| 2,986,438 | 5/1961 | Smathers et al. | 108/25 X |
| 3,094,264 | 6/1963 | Petrone . | |
| 3,135,391 | 6/1964 | Umstead . | |
| 3,244,125 | 4/1966 | Mackey . | |
| 3,638,849 | 2/1972 | Goings . | |
| 3,693,555 | 9/1972 | Holtzmann | 108/25 |
| 3,784,142 | 1/1973 | O'Brien . | |
| 3,875,873 | 4/1975 | Howitt | 108/25 |
| 4,010,696 | 3/1977 | Priesman | 108/19 |
| 4,033,461 | 7/1977 | Nevai | 108/25 X |
| 4,095,533 | 6/1978 | Leveille . | |
| 4,176,743 | 12/1979 | Fitzpatrick | 108/25 X |
| 4,539,455 | 9/1985 | Colato et al. | 108/19 X |
| 4,603,642 | 8/1986 | Brickman . | |
| 4,662,676 | 5/1987 | Havelock . | |

*Primary Examiner*—Jose V. Chen

*Attorney, Agent, or Firm*—Richard M. Rabkin

[57] ABSTRACT

A foldable tray table for supporting a variety of articles, including beverages in cans or tumblers, has a rigid, generally rectangular table top having one or more openings therethrough shaped and dimensioned to accept a beverage can or a book. The openings are not bottomed and are incapable of supporting an article placed therein until two pairs of legs pivotally joined to the table top near respective ends thereof are moved to their in-use position to support the table top horizontally at which a horizontal cross bar which integrally joins the legs of each pair is brought into position below a respective opening. The article is supported from the bottom by the cross bar, which is spaced some distance from the under surface of the table top, and is perimetrically supported by an edge or edges of an opening.

13 Claims, 4 Drawing Sheets

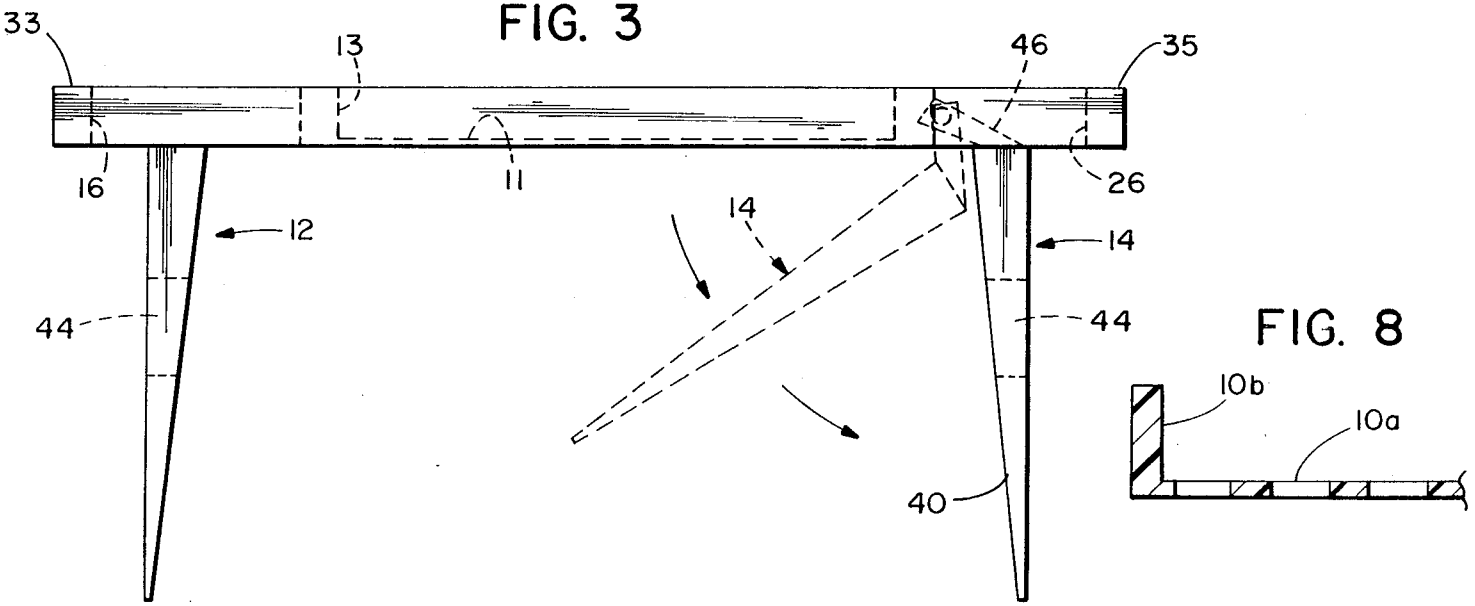
FIG. 3
FIG. 8
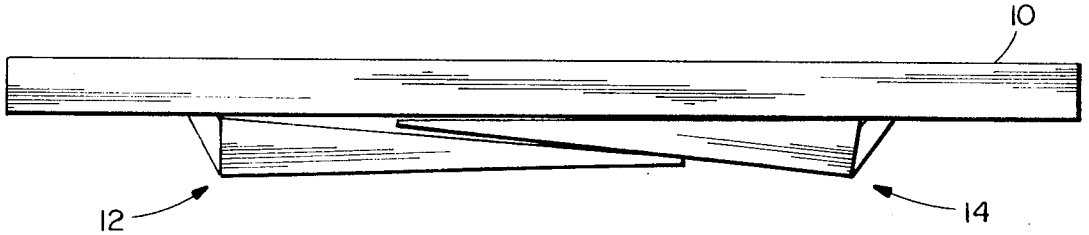
FIG. 4

FOLDABLE TRAY TABLE

BACKGROUND OF THE INVENTION

This invention relates generally to foldable tray tables and, more particularly, to a foldable tray table capable of supporting thereon straight sided articles such as a beverage can, a tumbler, a book or the like.

A primary object of the invention is to provide a lightweight tray table formed of parts that can be easily assembled having a table top usable as a tray when folded and capable of supporting an article such as a beverage container and/or a book when the legs of the table are unfolded.

Another object is to provide a lightweight foldable tray table that is particularly useful at the beach for supporting beverage cans and the like out of contact with the sand.

SUMMARY OF THE INVENTION

Briefly, the objects of the invention are achieved by providing a foldable table wherein two pairs of pivotable legs are secured near the opposite ends of a generally rectangular tray-like top, the top having openings therethrough located near its opposite ends. One or more of the openings may be circular and of a size to accept a beverage can or a tumbler, and another of the openings may be of rectangular shape and of a size to accept a book. The openings are not bottomed and thus are incapable of alone supporting an article, but when the legs are unfolded to depend from the top a crossbar that connects the legs of each pair is brought into position below the openings so as to form "bottoms" for the openings on which the lower end of a can or book, as the case may be, is supported. The cross bar supports the bottom of the can and the edge of the opening surrounds and engages the outer surface of the can; any condensation or spillage from the can falls freely to the ground below. The legs are tapered so that when the table is used at the beach they anchor the table in the sand by wedging action. The taper of the legs of the two pairs are complementary so that they can be folded, in any order, against the under surface of the table top and occupy very little space.

Other objects, features and advantages of the invention, and a better understanding of its construction and operation, will be had from the following detailed description taken in conjunction with the accompanying drawings.

BRIEF DESCRIPTION OF THE DRAWINGS

FIG. 3 is an elevation side view of the table;

FIG. 4 is a side view of the table with the legs folded;

FIG. 8 is a cross-sectional view taken along line 8—8 in FIG. 2.

DESCRIPTION OF THE PREFERRED EMBODIMENT

Figure 1:
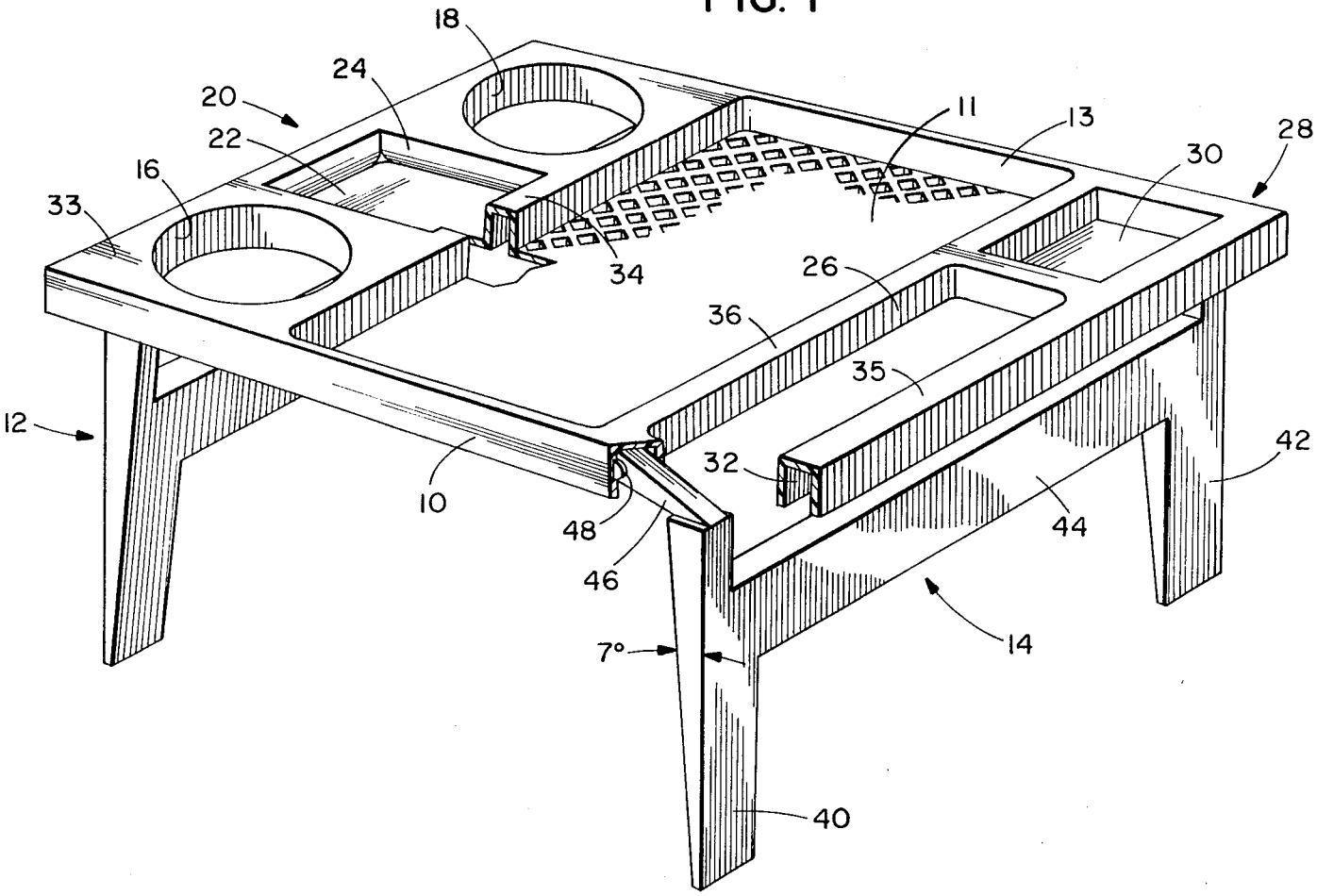
FIG. 1 is a perspective view, partially cut away, of a table constructed according to the invention showing it in the in-use or open position.
Figure 6:
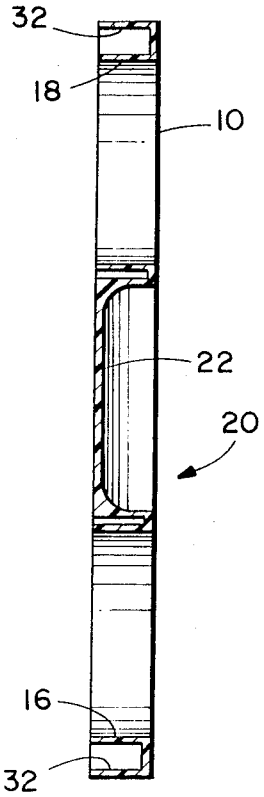
FIG. 6 is a cross-sectional view taken along line 6—6 in FIG. 2.
Figure 2:
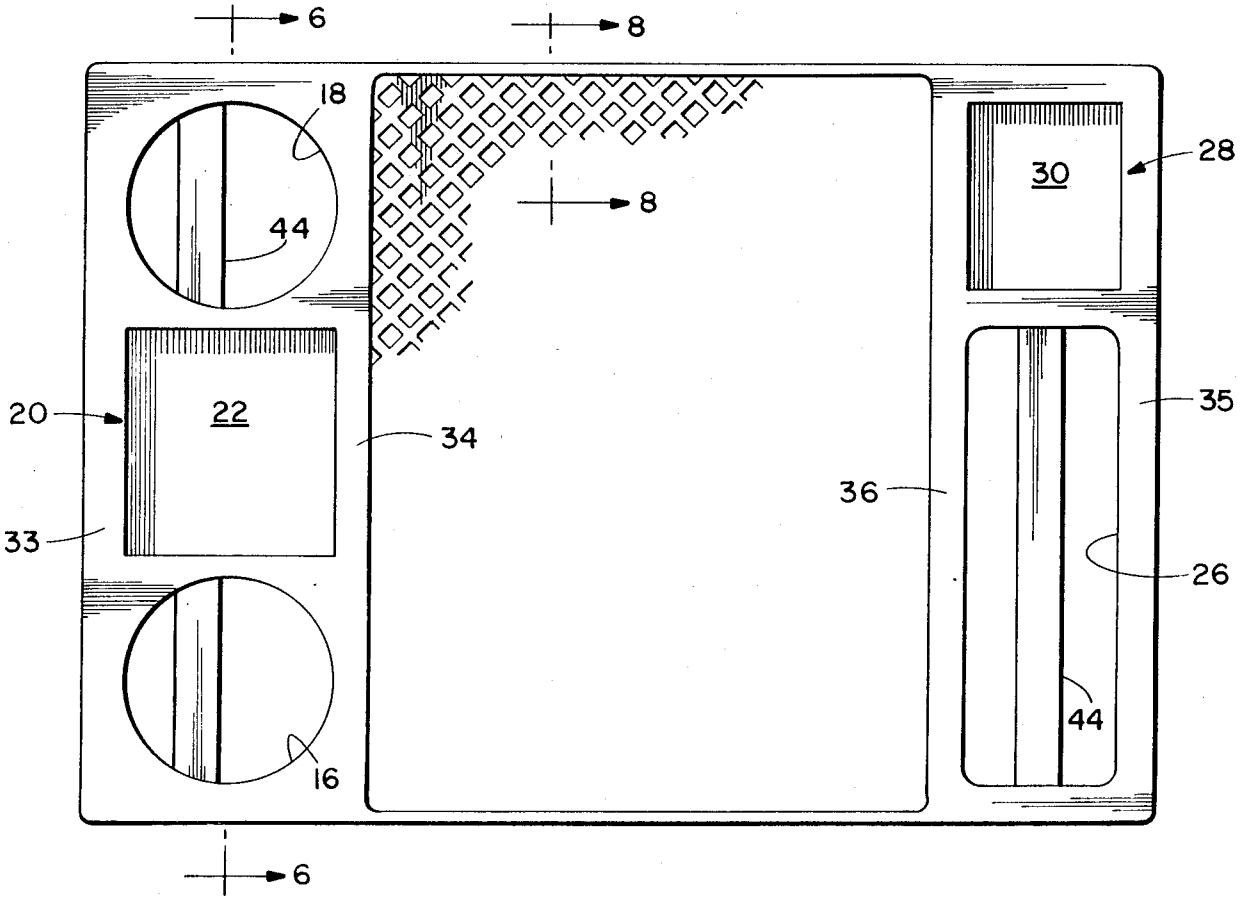
FIG. 2 is a top plan view of the table.
Figure 5:
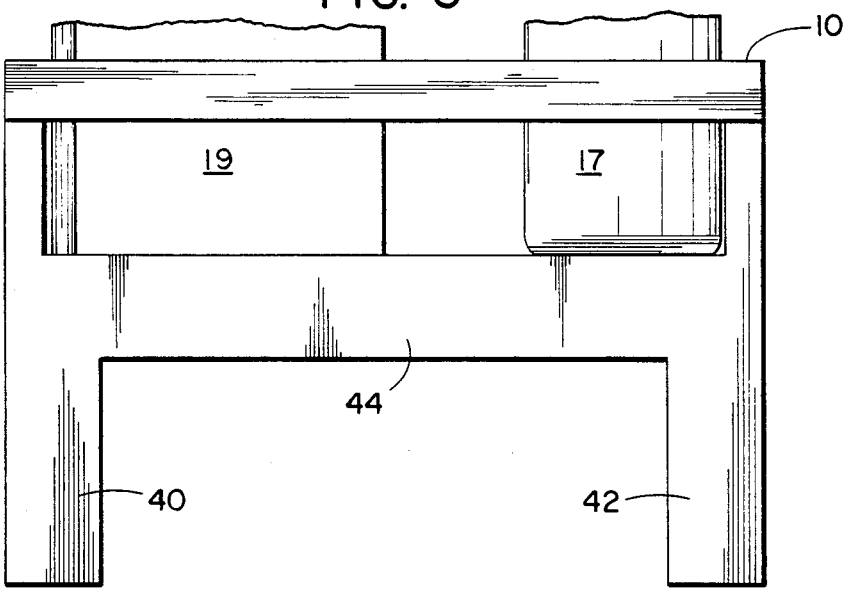
FIG. 5 is an elevation end view of the table.
Figure 7:
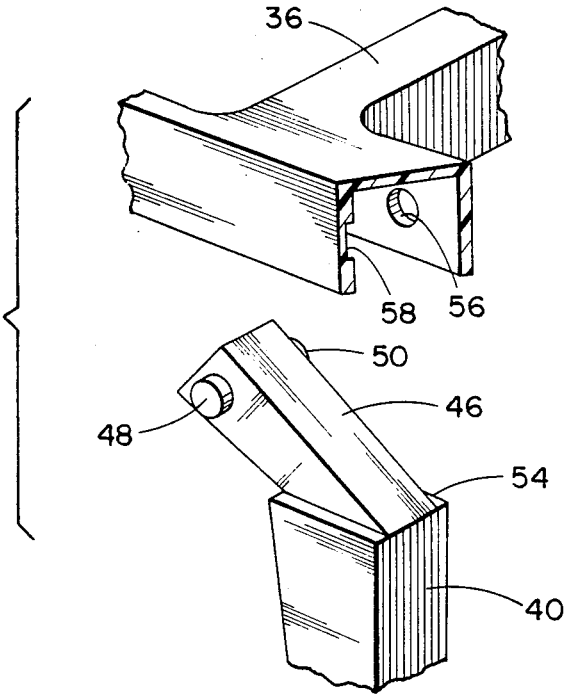
FIG. 7 is a fragmentary perspective view illustrating how the legs are attached to the table top.

Referring to the drawings, the foldable table according to the invention consists of three parts: a rectangular top 10, and two leg assemblies 12 and 14 pivotally connected to the top near respective opposite ends thereof. The three parts are formed of a suitable high impact plastics material which is molded by any desired molding method to the finished shapes.

The top 10, which typically may be 10″ wide and 14″ long, has a central, depressed perforated surface 11 surrounded by a rim 13 for supporting articles such as items that one might take to the beach; the perforations prevent the accumulation of sand or similar foreign particles and, at the same time reduce the weight of the table. Near the left end as viewed in FIG. 1, the top has a pair of circular openings 16 and 18 therethrough of a size that will accept a beverage can conventionally used for soda or beer, or other straight sided cylindrical article, such as a tumbler. The diameter of these openings may be 2.75″ and the height of the cylindrical wall, equal to the overall thickness of the top, may be $\frac{3}{4}$″; the openings are open on the bottom and without more would not support an article placed therein. A storage compartment 20 having a bottom surface 22 and sidewalls 24 is formed in the top in between the circular openings. At the other end the top has a rectangular-shaped opening 26 extending therethrough, typically 2″ wide and 6″ long, so as to be capable of accepting a book edgewise, a folded magazine, or the like. As in the case of the circular openings, this rectangular opening is open bottomed and would not without more, support a book. Another storage compartment 28 having a bottom 30 and constructed in the same way as compartment 20, is provided in the remaining corner of the table top.

A first pair of cross members 34 and 36 that define respective side edges of the perforated area 11, a second pair of cross members 33 and 35 that define edge areas at opposite ends of the table top and the portions of the side edges of the table top that join cross members 34, 35 and 35, 36, are formed to provide a downwardly-facing U-shaped channel 32 having a pair of sidewalls each about $\frac{3}{4}$″ wide and separated by about $\frac{1}{2}$″. This construction gives the table top the necessary rigidity while reducing the amount of plastic material necessary for its fabrication and therefore the weight of the finished table, and provides means for joining the legs to the table.

The two pairs of legs 12 and 14 are identical in construction and, accordingly, only the details of pair 14 will be described, with particular reference to FIGS. 1, 3, 5 and 7. The legs 40 and 42 of the pair are integrally joined by a rectangular cross bar 44, the outer surface of which is coplanar with the rectangular outer surfaces of legs 40 and 42. The inner surface of each leg and also the inner surface of crossbar 42 are tapered, typically at an angle of 7°, with respect to the outer surface. The width of the legs over that portion of their length from the lower end up to the lower edge of the cross bar may be 1.25″, and from the upper edge of the cross bar to the underside of the top the width corresponds to the outside width of U-shaped channel 32, typically $\frac{1}{2}$″, so that the channel edges are supported thereon when the legs are unfolded to the in-use portion. The upper end of each leg is pivotally hinged to the table top 10 by a hinge member 46, integrally joined to the upper end of leg 40, and which extends upwardly and inwardly at an angle such that when integral cylindrical pins 48 and 50 extending from the lateral surfaces of the hinge member engage respective circular pin-receiving depressions ("blind holes") formed in the interior sidewalls of the U-shaped channel, the lower edges of the downward-facing sidewalls of the channel are firmly supported on the shoulders 52 and 54 formed on either side of hinge member 46. One of the pin-receiving depressions is visible at 56 in FIG. 7, the assembly of the hinge member with the channel being facilitated by a groove 58 formed in the opposite inside wall of the channel that leads to a similar opening in that wall for receiving pin 48.

The pivotal connection afforded by pins 48 and 50 and their respective openings in the channel is located inwardly from the end of table top 10 by a distance such that when the legs are unfolded to their in-use position the upper edge of cross bar 44 of pair 14 is brought into position below the lengthwise center line of rectangular opening 26, and the upper edge of the cross bar of pair 12 is brought into position along and below the diameters of both circular openings 16 and 18. Thus, when the legs are unfolded to the downwardly depending position the cross bars 44 are disposed below respective openings and, in effect, provide "bottoms" for preventing articles placed in the openings from passing through. In the case of a beverage can 17 placed in circular opening 16, the bottom of the can is supported on the upper edge of the cross bar, which typically is $1\frac{3}{4}''$ below the under surface of the table top and is peripherally supported about mid-way of its height by the edge of the circular opening. Thus, the can is supported with minimum chance of tipping, and any condensation that may form on the exterior, or any spillage from the can, is free to fall to the ground below. Likewise, in the case of the rectangular opening, the upper edge of the crossbar is spaced sufficiently below the table top that a book 19 received edgewise in opening 26 will be supported with vertical orientation.

As best seen in FIGS. 3 and 4, the angular orientation of the hinge member 46 relative to the rest of the leg, together with the tapered inside surface allows the legs to be compactly folded up under the table top such that the folded assembly has a thickness only approximately twice that of the table top itself. Being complementary, the order in which the legs are folded does not affect the compactness. The tapering of the legs not only reduces the weight of the table and contributes to the aesthetics of the product, but is of particular advantage when the table is used at the beach in that a wedging action occurs to anchor the table in the sand.

Although an exemplary embodiment of the tray table has been disclosed and described, it will be understood that the disclosed structure may be subjected to changes, modifications and substitutions without necessarily departing from the spirit of the invention. For example, the openings and/or compartments may have different shapes, or may be arranged differently, to accommodate other types of articles, so long as the openings are located so that the cross bars which join the legs are brought into position below the openings when the legs are in the unfolded position. Beyond these possible modifications, other changes may be made by a designer for aesthetic reasons or for ease of manufacture while still coming within the scope of the appended claims.

We claim:

1. A foldable tray table comprising:

a rigid, generally rectangular table top having opposed side edges, opposed end edges and upper and under surfaces, said top having at least one opening extending therethrough from the upper surface to the under surface at a location near one end edge thereof, said opening having a size and shape to accept an article desired to be supported, and first and second pairs of equal-length, generally parallel legs each having an upper end and a lower end, the legs of each pair being integrally joined together by a transverse cross bar connected to both legs at the same predetermined distance below their upper end and spacing the legs by a distance substantially equal to the distance between the opposed side edges of said table top, each pair including means at the upper end of each leg for pivotally connecting it to a respective side edge of said table top at a location inwardly from a respective end edge thereof for movement between a first position in which said first pair of legs is folded over the legs of said second pair and the legs of said second pair are folded against the under surface of said table top and a second position in which the legs of both pairs depend substantially vertically from the under surface of said table top for supporting said table top substantially horizontally and the transverse cross bar which joins that pair of legs pivotally connected near said one end of said table top is positioned said predetermined distance below said at least one opening for providing bottom support for an article placed in the opening.

2. A foldable tray table according to claim 1, wherein said at least one opening is circular and has a diameter dimensioned to accept a circular cylindrical article such as a beverage can.

3. A foldable tray table according to claim 2, wherein said table top has at least a second opening therethrough located near the end thereof opposite said one end shaped and dimensioned to accept a rectangularly-shaped article such as a book or the like.

4. A foldable tray table according to claim 3, wherein the upper surface of the table top has a central shallow storage compartment formed therein intermediate the openings at its opposite ends.

5. A foldable tray table according to claim 4, wherein said storage compartment has a perforate bottom.

6. A foldable tray table according to claim 4, wherein the transverse edges of said storage compartment are defined by an exterior wall of a respective downwardly-facing U-shaped channel extending between the side edges of the table top.

7. A foldable tray table according to claim 1, wherein at least portions at the ends of both side edges of the table top comprise integral downwardly facing U-shaped channels having spaced opposite side walls, and wherein said means at the upper end of each leg comprises an integral hinge member extending angularly upward from the upper end thereof dimensioned to be received between the sidewalls of a respective U-shaped channel, said hinge member including means for pivotally joining the hinge member to the channel sidewalls.

8. A foldable tray table according to claim 7, wherein each transverse cross bar has a substantially rectangular cross-section and a horizontal upper edge spaced by said predetermined distance from the under surface of said table top when said legs are in said second position.

9. A foldable tray table according to claim 8, wherein the legs of a pair and the transverse cross bar integrally joining them have a coplanar outwardly facing and substantially vertically oriented surface when the legs are in said second position, and wherein the surface of the legs of a pair and the transverse cross bar integrally joining them that faces inwardly when the legs are in said second position are coplanar and disposed in a plane displaced angularly inward from said outwardly facing surface.

10. A foldable tray table comprising:

a generally rectangular table top molded of rigid plastic having an upper surface and an underside, opposed end edges, and opposed side edges end portions of which comprise integral downwardly facing U-shaped channels each having apertures arranged on its opposite sidewalls, said table top having at least one opening extending therethrough at a location near one end thereof, and first and second leg assemblies molded of rigid plastic each comprising a pair of generally parallel legs spaced from each other a distance substantially equal to the distance between the side edges of the table top by an integral transverse cross bar connected to both legs at the same predetermined distance below an upper end thereof, and each leg including means at its upper end for engaging said apertures in the sidewalls of a respective side edge channel and pivotally connecting a leg assembly to said table top at a location inwardly from a respective end edge for movement between a first position in which one leg assembly is folded over the other and the other is folded against the under side of the table and a second position in which both leg assemblies depend substantially vertically from the underside of said table top for supporting said table top substantially horizontally and the cross bar of the assembly pivotally connected near said one end of said table top is positioned said predetermined distance below said at least one opening for providing bottom support for an article placed in the opening.

11. A foldable tray table according to claim 10, wherein said at least one opening is shaped and dimensioned to receive a circular cylindrical article such as a beverage can, and wherein said table top has at least a second opening extending therethrough at a location near the end opposite said one end, said second opening being shaped and dimensioned to accept a rectangularly shaped article such as a book or the like.

12. A foldable tray table according to claim 11, wherein the upper surface of said table top has formed therein a transverse shallow storage compartment disposed between said first and second openings, the transverse edges of which are defined by an exterior wall of a respective downwardly-facing U-shaped channel extending between the side edges of the table top.

13. A foldable tray table according to claim 10, wherein each leg assembly has a planar outwardly facing surface and a planar inwardly facing surface disposed in a plane displaced angularly inward from said outwardly facing surface in the direction from the lower to the upper end of the legs, and wherein each cross bar has a substantially rectangular cross-section.

* * * * *